US006241405B1

(12) United States Patent
Burman et al.

(10) Patent No.: US 6,241,405 B1
(45) Date of Patent: Jun. 5, 2001

(54) PRINTER HEAD FOR A BRAILLE PRINTER AND A METHOD OF MANUFACTURING THE SAME

(75) Inventors: Par Burman, Gammelstad; Bjorn Lofstedt, Lulea, both of (SE)

(73) Assignee: Index Braille Printer Company AB, Gammelstad (SE)

( * ) Notice: Subject to any disclaimer, the term of this patent is extended or adjusted under 35 U.S.C. 154(b) by 0 days.

(21) Appl. No.: 09/341,839

(22) PCT Filed: Oct. 21, 1998

(86) PCT No.: PCT/SE98/01900

§ 371 Date: Sep. 9, 1999

§ 102(e) Date: Sep. 9, 1999

(87) PCT Pub. No.: WO99/25559

PCT Pub. Date: May 27, 1999

(30) Foreign Application Priority Data

Nov. 19, 1997 (SE) ..... 9704242

(51) Int. Cl.[7] ..... B41J 3/32

(52) U.S. Cl. ..... 400/109.1; 341/21

(58) Field of Search ..... 400/109.1, 118.2, 400/124.08; 101/18, 93.04, 93.34; 341/21

(56) References Cited

U.S. PATENT DOCUMENTS 4,397,573 8/1983 Thiel .
4,735,516 4/1988 Galarneau .
4,741,634 * 5/1988 Nozaki et al. ..... 400/120
5,153,605 * 10/1992 Ohara et al. ..... 346/76
5,222,819 * 6/1993 Tsududa et al. ..... 400/122
5,527,117 * 6/1996 Roy ..... 400/109.1
5,708,762 * 1/1998 Chiba et al. ..... 395/108
6,045,275 * 4/2000 Hosoya ..... 400/120.01

FOREIGN PATENT DOCUMENTS 2 419 820 10/1979 (FR) .

* cited by examiner

*Primary Examiner*—John S. Hilten
*Assistant Examiner*—Darius N. Cone
(74) *Attorney, Agent, or Firm*—Pillsbury Winthrop LLP

(57) ABSTRACT

A printer head for a Braille printer includes a housing formed with first and second series of opposing openings. First devices adapted to receive Braille paper to be taken up in the housing and second devices arranged in the housing to apply raised dots onto the paper are accommodated in the first and second series of openings formed in the housing. The housing includes a base section designed as one piece with a channel-shaped space where the devices that apply the raised dots onto the Braille paper are accommodated in the first and second series of opposing openings. The first and second series of opposing openings in the one piece base section are formed in a same mounting so as to be substantially coaxially aligned as a mutual pair, whereby the devices are arranged mutually opposite to each other in the channel-shaped space at a predetermined distance from one another with centers of axes aligned. The Braille paper is received between the devices that apply the raised dots through at least one paper opening arranged in the channel-shaped space.

19 Claims, 1 Drawing Sheet

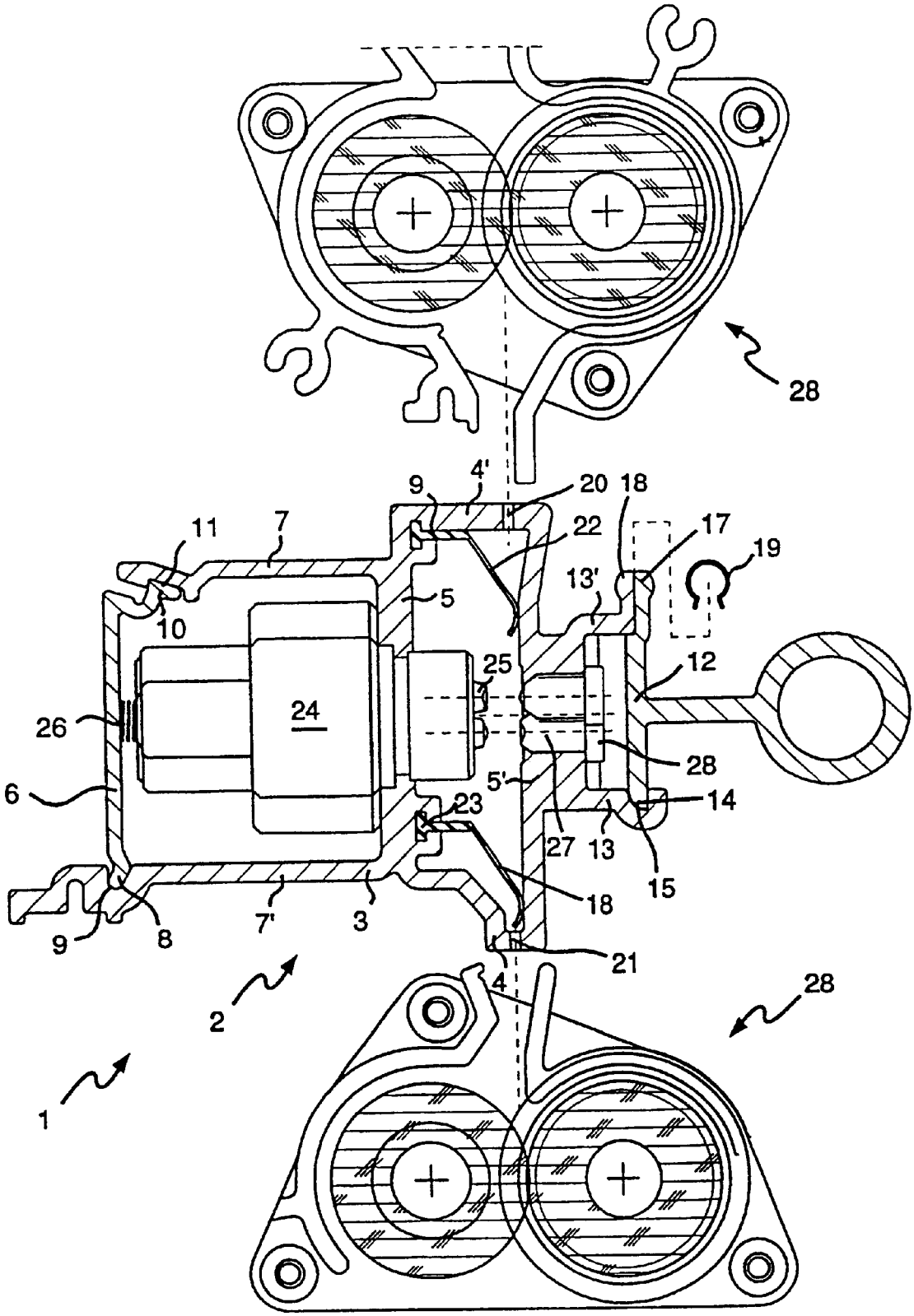
28
4'
9
20
18
11
7
22
17
19
13'
5
10
12
25
24
26
28
5'
6
14
23
27
13
15
18
9
8
7'
3
21
4
2
28
1

PRINTER HEAD FOR A BRAILLE PRINTER AND A METHOD OF MANUFACTURING THE SAME

This application is the national phase of international application PCT/SE98/01900 filed Oct. 21, 1998 which designated the U.S.

FIELD OF THE INVENTION

The present invention relates to a printer head for a Braille printer that includes a housing with a device to allow the Braille paper to be taken up into the housing, as well as a device arranged in the housing to apply the raised dots onto the said paper. The invention also relates to a method for manufacturing a printer head.

BACKGROUND OF THE INVENTION

A printer head for a Braille printer is previously known from U.S. Pat. No. 4,735,516. This printer head includes a rigid frame that is made up of a number of elements that can be displaced along guide rails. The frame supports a number of solenoids that have a needle/small rod at one of their ends that interacts with a counter hole, also supported on the frame, in the form of an indentation/die cushion to form the raised dots on Braille paper positioned between the needle and the counter hole when the solenoid is activated and displaces the needle towards the counter hole.

To make the manufacture of a frame for a printer head for a Braille printer more efficient, a technique has been developed where the said frame has the form of a housing that usually consists of two extrusion moulded parts, preferably extrusion moulded aluminium, that are joined together to form the said housing. One of the frame parts supports the solenoids with the needles while the other frame part supports the counter holes/die cushions. To allow the Braille paper onto which the raised dots are to be introduced to pass through the printer head and past a space formed in the housing in which the needle and the counter hole have their effect, the said parts are usually designed so that between themselves they have opposing slit-shaped openings. However, a major problem with this construction design is the mutual positioning accuracy of the mounting positions that accommodate the solenoids respective die cushions, whereby the mounting of the solenoids and dies respectively, for example by means of screwing, takes place from the sides of the frame parts that, when they are to be joined together, are turned to face one another. When the frame parts have been joined together, it has been shown that it is extremely difficult to obtain sufficiently exact tolerances regarding the above named mutual positioning accuracy between the solenoids and the associated die cushions. Here it should be pointed out that the correct accuracy of this positioning is of crucial importance for the whole construction. If this is not accurate, the Braille paper can be damaged and the result will not be fully acceptable as a raised dot. To try and correct this problem, adjustments have had to be made afterwards, which is time-consuming and costly. In addition, the final result has often not been satisfactory, despite this subsequent adjustment.

SUMMARY OF THE INVENTION

The objective of the present invention is to achieve a printer head of the type defined in the introduction that does not have the said disadvantages regarding the technology as discussed above. The primary objective with the printer head according to the present invention is to achieve a fully acceptable mutually accurate positioning between the solenoids, or other suitable activating devices, and the associated die cushions, whereby any form of subsequent adjustment should, in principle, not be necessary. A further objective of the present invention is that the mounting of the solenoids and die cushions should be able to be carried out in a simple manner, whereby even service and maintenance of the solenoids and die cushions should also be able to be carried out in a quick and easy manner. The objectives of the invention are accomplished by an arrangement and a method that have the characteristics as stated in the following claims.

BRIEF DESCRIPTION OF THE DRAWINGS

One embodiment of the invention will be described below with reference to the FIGURE that in a side elevation view and partly in cross-section shows schematically the printer head according to the present invention and where some of the surrounding equipment has also been included.

DETAILED DESCRIPTION OF THE PREFERRED EMBODIMENTS

According to the invention, a printer head 1 includes a housing 2 that in turn includes a base section 3 formed as one piece and having a channel-shaped space formed by an integrated envelope surface of walls 4 respectively 4' and cross-walls 5 respectively 5'. The base section is preferably extrusion moulded in aluminium and as such has an extension at right angles to the plane of the paper in the figures. At the left hand end of the base section 3 as seen in the figure there is a first aperture flap 6 in housing 2 that has an extension at right angles to the plane of the paper equivalent to that of the base section, and that interacts with a groove formed by two projections 7, 7' extending outwards from the base section that are separated at a distance from one another. The lower edge 8 of the first aperture flap 6 is accommodated in a first groove 9 formed in the lower projection 7' of the base section 3 and that also has an extension at right angles to the plane of the paper in the figures. The first aperture flap 6 can thus be pivoted relative to its lower edge 8. At its upper edge, the first aperture flap 6 is provided with a catch 10 that interacts with a groove 11 formed in the end section of the upper projection 7 of the base section 3. In this way, the aperture flap 6 can partly take up a locked position where the catch 10 snaps into the second groove 11, and partly a position where the aperture flap 6 is swung out around its lower edge 8.

At the right hand edge of the base section 3 as seen in the figure, there is a second aperture flap 12 in housing 2 where the aperture flap has an equivalent extension at right angles to the plane of the paper in the figures, and where the flap interacts with a groove formed by two projections 13, 13' extending outwards from the base section. The lower edge 14 of the second aperture flap 12 is accommodated in a groove 15 formed in the lower projection 13 of the base section 3 where the groove also has an extension at right angles to the plane of the paper in the figures. The second aperture flap 12 can thus be pivoted around its lower edge 14. At its upper edge 16, the second aperture flap 12 is provided with a rib 17 that interacts with a rib 18 formed on the end section of the upper projection 13' that extends out from base section 3, whereby the said ribs 17 and 18 have flat sections that rest against one another when the second aperture flap 12 takes up a closed position and is locked in the said closed position by clamps 19 being snapped over the ribs 17 and 18 that rest against one another. In the position shown in the figure, i.e. where the clamps 19 are not snapped in position over the ribs 17 and 18, the second aperture flap can be opened by pivoting around its lower edge 14.

In a part of the base section 3 found between the aperture flaps 6 and 12, the base section is provided with first and second openings in the form of slots 20 respectively 21 through pairs of opposing walls 4 respectively 4' of the base section 3 that form the channel-shaped space. The said slots 20, 21 are preferably produced by a suitable chip cutting machining operation, for example, by milling. As the first and second slots 20 and 21 are intended to accommodate the Braille paper (indicated in the figure with a dashed line) that passes through the printer head, slots 20 and 21 have an extension at right angles to the plane of the paper that is in principle equivalent to the width of the Braille paper. It should be realised that the said slots have an extension that only constitutes a limited part of the total length of the base section 3 so that this can always be handled as one single integrated piece.

Leaf spring blades 22 in the form of extrusion moulded plastic profiles are arranged adjacent to the first and second slots 20 and 21 respectively. These are anchored in the first cross-wall 5 of the base section 3 by T-shaped sections 23 of the said profiles 22 that are inserted into equivalent T-shaped grooves formed in the said wall. The task of these profiles 22 is to interact together with the second cross-wall 5' in the channel-shaped space of the base section 3 and guide the Braille paper down through the printer head 1, whereby the Braille paper runs between the said leaf blade springs 22 and the cross-wall 5'.

In housing 2, or more specifically in the base section 3 of the printer head 1, devices are mounted to achieve the raised dots on the Braille paper that passes through the printer head 1 as indicated by the dashed line in the figure. In the embodiment shown, these devices include several solenoids 24, one of which is shown in the figure. On its right hand side in the figure, the solenoid 24 has so-called hammers 25 that move in a direction to the right in the figure when solenoid 24 is activated. Solenoid 24 is mounted in housing 2, more specifically, in a first opening of a series of openings in the first cross-wall 5 of the base section 3. Solenoid 24 is mounted by opening the first aperture flap 6 and inserting the solenoid 24 through the mounting opening so created and pushing it in into the said first opening in the first cross-wall 5 until the collar projection part of the solenoid 24 comes to rest against the cross-wall 5. To locate the solenoid 24 firmly in the first opening in the first cross-wall 5, the first aperture flap 6 (see FIGURE) is closed, whereby the pressure spring 26 mounted on the inside of the first aperture flap 6 exerts a force on the solenoid 24 in the right hand direction in the figure and locates this firmly in the first opening in the first cross-wall 5.

The device for achieving the raised dots also includes a number of die cushions 27, two of which are shown in the figure, arranged directly opposite the associated hammers and interacting with these to achieve the raised dots on the Braille paper. The die cushions 27 are accommodated in second openings in a series of openings in the second cross-wall 5', whereby mounting of the die cushions 27 takes place by opening the second aperture flap 12 and inserting the die cushions through the mounting opening so formed and mounting them in the said second openings, whereby an elastic element such as a thin rubber sheet or similar (not shown) is positioned between the said second aperture flap 12 and the die cushions 27. after which the second aperture flap 12 is closed. The die cushions 27 are located firmly in that the collars 28 of the cushions are pressed by the second aperture flap 12 so that they lie tightly against the second cross-wall 5'.

It should be realised that the series of first openings in the first cross-wall 5 for accommodating the solenoids 24 and the series of second openings in the second cross-wall 5' for accommodating the die cushions 27 are coaxially oriented as mutual pairs and are advantageously formed in the same chuck mounting and fixing in a machining tool. It is also worth considering that the said coaxial openings in the respective cross-walls 5, 5' could be made from one single direction by choosing a suitably step-shaped machine tool, such as the use of a so-called step drill and step-shaped milling tools. If the above mentioned machine tool for chip machining is constituted of a so-called multi-operational tool, it is suitable for both the milling of the said slots 20 and 21 and the hole boring to take place in the same chuck mounting and fixing. It should be thus realised that in this way it is possible to obtain a very high accuracy of location and close tolerances not only between the hole pattern in the respective cross-walls 5, 5' but also between the said hole pattern and the slots 20, 21 for accommodating the Braille paper.

According to the present invention, the printer head 1 works in the following way. The feeding reels 28 shown in the figure above and below the printer head 1 feed Braille paper through slots 20 and 21, whereby the spring profiles 22, by interacting with the inside of the second cross-wall 5', guide the Braille paper past the device for achieving the raised dots on the said paper. Due to the arrangement according to the invention. i.e. that the base section 3 of the housing is formed in one piece and that all milling for machining the holes, etc. is performed on this one piece, the hammers 25 of the solenoid 24 and the associated die cushions 27 are always positioned in a predetermined, specified distance from one another, and with centres of axes that coincide. This means that when solenoid 24 is activated and one or both of the hammers 25 move to the right in the figure, the associated die cushions 27 will always form a counter hole at the correct distance from solenoid 24, which in turn results in the raised dots formed on the Braille paper not damaging the paper and that also being formed in an optimal manner.

According to the invention, the parts of the printer head 1 are preferably made of extrusion moulded aluminium profiles. However, within the scope of the invention, one can also consider that other materials could be used, such as plastic, for example. Suitable activating devices other than solenoids can naturally also be used. From that stated above, it should be evident that the printer head according to the invention displays completely satisfactory coaxial mutual location accuracy and a precise distance between the hammers and the die cushions. It should also be realised that the said solenoids and die cushions can be mounted in a simple and efficient manner from the outside of the base section of the housing.

The invention is nevertheless not limited to that shown and described above but that several modifications of it are possible within the scope of the concept of the invention specified in the following claims.

What is claimed is:

1. Printer head for a Braille printer comprising:

a housing formed with first and second series of opposing openings; and first devices adapted to receive Braille paper to be taken up in the housing; and second devices arranged in the housing to apply raised dots onto the paper, the second devices being accommodated in the first and second series of opposing openings formed in the housing;

the housing including a base section designed as one piece with a channel-shaped space where the second devices for applying the raised dots onto the Braille paper are accommodated in the first and second series of opposing openings and are surrounded by the housing, the first and second series of opposing openings in the one piece base section being formed in a same mounting so as to be substantially coaxially aligned as a mutual pair, such that the second devices are arranged mutually opposite to each other in the channel-shaped space at a predetermined distance from one another with centers of axes aligned, and the Braille paper being received between the second devices that apply the raised dots through at least one paper opening arranged at the channel-shaped space.

2. Printer head according to claim 1, further comprising two paper openings provided within the channel-shaped space, the two paper openings allowing the Braille paper to run therebetween.

3. Printer head according to claim 2, in which the channel-shaped space is primarily rectangular in cross-section and includes a pair of walls and cross-walls arranged at a distance from one another, such that the first and second series of opposing openings accommodating the second devices for applying the raised dots onto the Braille paper are arranged in the cross-walls and the two paper openings that allow the Braille paper to run through the housing are arranged in the walls.

4. Printer head according to claim 3, in which the first and second series of opposing openings in the cross-walls and the two paper openings in the walls respectively are mutually coaxially arranged and the second devices for applying the raised dots onto the Braille paper include a plurality of solenoids equipped with hammers that interact with die cushions, such that the solenoids in their fixed positions are accommodated in the first series of openings in the channel-shaped space, and the die cushions in their fixed positions are accommodated in the second series of openings.

5. The printer head according to claim 1, in which the at least one paper opening is slot-shaped.

6. The printer head according to claim 1, in which the one piece base section is made by extrusion molding.

7. The printer head according to claim 1, in which the first and second series of opposing openings are formed by a multi-operational tool so that the first and second series of opposing openings are aligned.

8. The printer head according to claim 7, in which the multi-operational tool is a step drill.

9. Printer head for a Braille printer comprising:

a housing;

first devices adapted to receive Braille paper to be taken up in the housing; and second devices arranged in the housing to apply raised dots onto the paper;

the housing including a base section designed as one piece with a channel-shaped space where the second devices for applying the raised dots onto the Braille paper are accommodated in a first and second series of opposing openings, such that the Braille paper is received between the second devices that apply the raised dots through two paper openings arranged in the channel-shaped space to allow the Braille paper to run therebetween, and the Braille paper being guided through the channel-shaped space by leaf spring devices that are accommodated in grooves running along the wall of the channel-shaped space by tightly fitting T-shaped sections, such that the sprung part of the device interacts with the inside of the channel-shaped space that serves as a smooth sliding surface for the Braille paper.

10. Printer head for a Braille printer comprising:

a housing;

first devices adapted to receive Braille paper to be taken up in the housing; and second devices arranged in the housing to apply raised dots onto the paper;

the housing including a base section designed as one piece with a channel-shaped space where the second devices for applying the raised dots onto the Braille paper are accommodated in a first and second series of opposing openings, such that the Braille paper is received between the second devices that apply the raised dots through two paper openings arranged in the channel-shaped space to allow the Braille paper to run therebetween, the channel-shaped space primarily rectangular in cross-section and including a pair of walls and cross-walls arranged at a distance from one another, such that the first and second series of opposing openings accommodating the devices that apply the raised dots onto the Braille paper are arranged in the cross-walls and the paper openings that allow the Braille paper to run through the housing are arranged in the walls, the first and second series of opposing openings in the cross-walls and the two paper openings in the walls respectively being mutually coaxially arranged and the second devices that apply the raised dots onto the Braille paper including a plurality of solenoids equipped with hammers that interact with die cushions, such that the solenoids in their fixed positions are accommodated in the first series of openings in the channel-shaped space, and the die cushions in their fixed positions are accommodated in the second series of openings, and the base section having two projections extending out from the base section at a distance from one another to form an aperture surrounding the solenoids that can be closed by an aperture flap, such that the flap, when in its closed position, firmly positions the solenoids in the respective first series of openings in the channel-shaped space by a spring device.

11. Printer head for a Braille printer comprising:

a housing;

first devices adapted to receive Braille paper to be taken up in the housing; and second devices arranged in the housing to apply raised dots onto the paper;

the housing including a base section designed as one piece with a channel-shaped space where the second devices for applying the raised dots onto the Braille paper are accommodated in a first and second series of opposing openings, such that the Braille paper is received between the second devices that apply the raised dots through two paper openings arranged in the channel-shaped space to allow the Braille paper to run therebetween, the channel-shaped space being primarily rectangular in cross-section and including a pair of walls and cross-walls arranged at a distance from one another, such that the first and second series of opposing openings accommodating the devices that apply the raised dots onto the Braille paper are arranged in the cross-walls and the paper openings that allow the Braille paper to run through the housing are arranged in the walls, the first and second series of opposing openings in the cross-walls and the two paper openings in the walls respectively being mutually coaxially arranged and the second devices that apply the raised dots onto the Braille paper including a plurality of solenoids equipped with hammers that interact with die cushions, such that the solenoids in their fixed positions are accommodated in the first series of openings in the channel-shaped space, and the die cushions in their fixed positions are accommodated in the second series of openings, and the base section having two projections arranged at a distance from one another to form an aperture that can be closed by an aperture flap, such that the flap, when in its closed position, firmly positions the die cushions in their respective second series of openings in the channel-shaped space.

12. A process for manufacturing a printer head for a Braille printer having a housing and first devices adapted to receive Braille paper to be taken up in the housing and second devices arranged in the housing and surround by the housing for applying raised dots onto the paper, said process comprising:

forming a base section that is included in the housing in one piece, including a channel-shaped space formed by a continuous integrated envelope surface, providing a first and second series of opposing openings in the housing, the first and second series of openings in the one piece base section being coaxially oriented as mutual pairs and being formed in a same mounting such that the devices for applying the raised dots onto the paper in the channel-shaped space are arranged at a predetermined specified distance from one another with aligned centers of axes, and providing at least one paper opening at the channel-shaped space to allow the Braille paper to be taken up in the channel-shaped space.

13. The process according to claim 12, further comprising providing the channel-shaped space with two paper openings to allow the Braille paper to run through the space.

14. The process according to claim 12, further comprising:

providing a plurality of solenoids with hammers that interact with die cushions such that the second devices apply the raised dots onto the Braille paper, providing the first and second series of openings that are mutually coaxially arranged with respect to one another in the channel-shaped space, and disposing the first and second series of openings so that the plurality of solenoids, when located in position, are accommodated in the first series of openings, and the die cushions, when located in position, are accommodated in the second series of openings.

15. The process according to claim 12, further comprising:

locating the second devices for applying the raised dots onto the Braille paper in position by using first and second aperture flaps interacting with apertures arranged in the base section and surrounding the second devices, the aperture flaps, in their closed position, exerting forces on the second devices to locate the second devices firmly in position.

16. The process according to claim 12, further comprising:

mounting the second devices for applying the raised dots onto the Braille paper in position in the base section from two opposing directions.

17. The process according to claim 12, in which the one piece base section is formed by extrusion molding.

18. A process for manufacturing a printer head for a Braille printer having a housing and first devices adapted to receive Braille paper to be taken up in the housing and second devices arranged in the housing for applying raised dots onto the paper, said process comprising:

forming a base section that is included in and surrounded by the housing in one piece, including a channel-shaped space formed by a continuous integrated envelope surface, providing a first and second series of opposing openings in the housing, providing at least one paper opening at the channel-shaped space to allow the Braille paper to be taken up in the channel-shaped space, providing a plurality of solenoids with hammers that interact with die cushions such that the second devices apply the raised dots onto the Braille paper, providing the first and second series of openings in the channel-shaped space, and disposing the first and second series of openings so that the plurality of solenoids, when located in position, are accommodated in the first series of openings, and the die cushions, when located in position, are accommodated in the second series of openings.

19. A process for manufacturing a printer head for a Braille printer having a housing and first devices adapted to receive Braille paper to be taken up in the housing and second devices arranged in the housing for applying raised dots onto the paper, said process comprising:

forming a base section that is included in and surrounded by the housing in one piece, including a channel-shaped space formed by a continuous integrated envelope surface, providing a first and second series of opposing openings in the housing, providing at least one paper opening at the channel-shaped space to allow the Braille paper to be taken up in the channel-shaped space, and locating the second devices for applying the raised dots onto the Braille paper in position by using first and second aperture flaps interacting with apertures arranged in the base section and surrounding the second devices, the aperture flaps, in their closed position, exerting forces on the second devices to locate the second devices firmly in position.

* * * * *